United States Patent [19]

Ratcliff et al.

[11] 4,400,024

[45] Aug. 23, 1983

[54] NOZZLE RETAINING RING WITH CRUSHED O-RING

[75] Inventors: Frank C. Ratcliff, Midland; Edward M. Galle, Friendswood, both of Tex.

[73] Assignee: Hughes Tool Company, Houston, Tex.

[21] Appl. No.: 288,712

[22] Filed: Jul. 31, 1981

[51] Int. Cl.[3] ..... F16L 19/00; F16L 55/00; E21B 10/18

[52] U.S. Cl. ..... 285/356; 285/39; 175/340

[58] Field of Search ..... 285/356, 39; 175/339, 175/340, 422

[56] References Cited

U.S. PATENT DOCUMENTS

| | | | |
|---|---|---|---|
| 2,085,941 | 7/1937 | Arnold | 255/64 |
| 2,169,223 | 8/1939 | Christian | 255/61 |
| 2,525,667 | 10/1950 | Goolsbee et al. | 285/163 |
| 2,719,026 | 9/1955 | Boice | 255/302 |
| 2,885,185 | 5/1959 | Sartor | 255/313 |
| 2,950,090 | 8/1960 | Gwart | 175/340 |
| 3,207,241 | 9/1965 | Neilson | 175/340 |
| 3,688,853 | 9/1972 | Maurer | 175/340 X |
| 3,823,789 | 7/1974 | Garner | 175/340 |
| 4,077,482 | 3/1978 | Ioannesian et al. | 175/340 |
| 4,301,877 | 11/1981 | Cloud | 175/340 |

FOREIGN PATENT DOCUMENTS

| | | | |
|---|---|---|---|
| 453217 | 12/1934 | United Kingdom | 285/343 |

OTHER PUBLICATIONS 1 p. of Parker Catalogue.

*Primary Examiner*—Richard J. Scanlan, Jr.
*Attorney, Agent, or Firm*—Robert A. Felsman; James E. Bradley

[57] ABSTRACT

An earth boring bit has a nozzle assembly with a wedging retaining ring and a crushed O-ring seal. The nozzle is located in a passage in the drill bit and bears against a shoulder. The retaining ring is secured by threads into the passage to tighten the nozzle against the shoulder. The retaining ring has a bore with an upper rim that encircles a conical section in the bore. The retaining ring conical section mates with a conical section formed on the exterior of the nozzle. The two conical sections wedge the nozzle in place when the retaining ring is tightened. An O-ring is located between the nozzle conical section, the wall of the passage and the upper rim of the retaining ring.

5 Claims, 3 Drawing Figures

NOZZLE RETAINING RING WITH CRUSHED O-RING

BACKGROUND OF THE INVENTION

This invention relates in general to earth boring drill bits, and in particular to an improved drill bit nozzle for discharging drilling fluid against the bottom of a borehole.

The most common type of bit for drilling oil and gas wells has three rotatable and generally conical cutters. The cutters have teeth that disintegrate the earth's formations during drilling. Fluid is pumped down the drill string and discharged out three outlets in the bit. The fluid cools the bit and circulates cuttings up the borehole to the surface of the earth.

One type of drilling fluid is a liquid slurry known as "mud" that often contains particulates such as abrasive sand particles. Nozzles formed of sintered tungsten carbide are mounted in the fluid outlets of the bit to reduce erosion. Each nozzle is a short cylinder with a converging axial bore. Because of the high pumping pressures and the abrasive mud, the nozzles have to be firmly secured in the outlets to avoid movement. Also, any retainer must be shielded to some extent to avoid erosion. In addition, the exterior wall of the nozzle must be sealed within the outlet to prevent fluid from leaking between the walls of the outlet and the nozzle and eventually eroding the outlet.

One common type of nozzle assembly employs a snap ring located within a groove formed in the outlet immediately below the bottom of the nozzle. If the mud is exceptionally abrasive, a nozzle with a shroud or extended portion may extend down below the snap ring to avoid erosion. For sealing, an O-ring is located within a groove formed in the outlet for sealing against the exterior of the nozzle.

While this nozzle assembly is successful, close tolerances are necessary for locating the grooves for the retaining ring and O-ring. Also, fatigue cracks occasionally result between the shroud of the nozzle, if a shroud is used, and the body of the nozzle.

Another nozzle assembly in use uses a threaded ring for tightening against the nozzle. One type has a ring with a tapered inner bore that wedges against a mating taper formed on the nozzle. While this method rigidly locks the nozzle to the bit, the O-ring for this assembly is still located within a groove in a conventional manner, and thus requires precise machining.

SUMMARY OF THE INVENTION

In this invention, the nozzle has a taper on its exterior. A retaining ring with exterior threads is screwed into the passage outlet. The retaining ring also has a taper that mates with the taper on the nozzle for wedging the nozzle tightly in the passage. An elastomeric seal, preferably an O-ring, is located between the upper rim of the retaining ring, the tapered surface of the nozzle, and a cylindrical wall of the passage. Tightening the retaining ring crushes and deforms the O-ring in this space, providing a seal without the need for close tolerance machining.

DESCRIPTION OF THE PREFERRED EMBODIMENT

Figure 1:
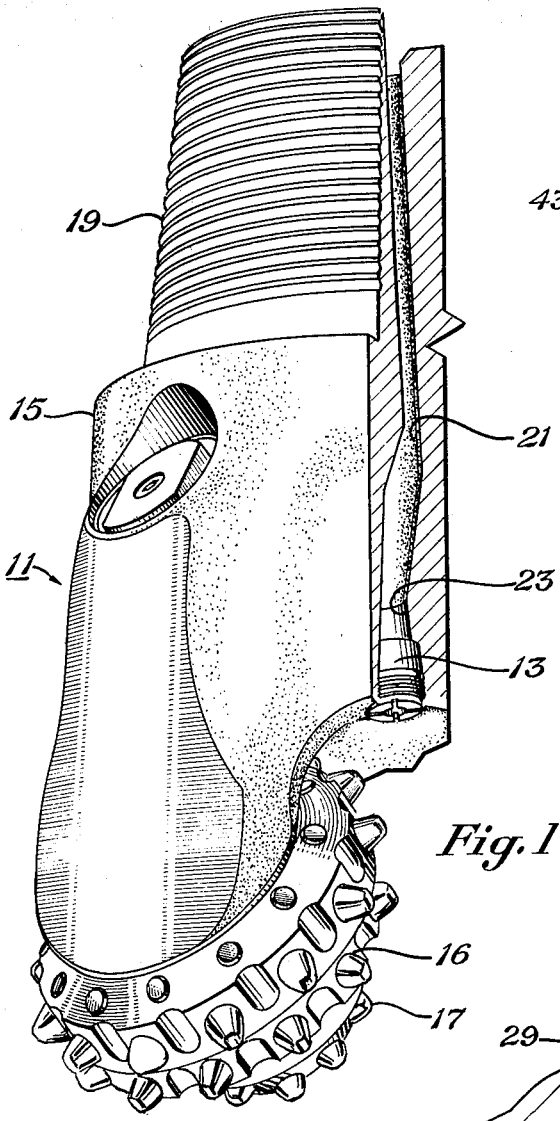
FIG. 1 is a fragmentary, perspective view of a portion of a drill bit, partially sectioned, showing a nozzle constructed in accordance with this invention.

FIG. 1 discloses a conventional drill bit 11 having a nozzle 13 constructed in accordance with this invention. Drill bit 11 has a body 15 comprised of three head sections welded together during assembly. A rotatable cutter 16 is mounted to a depending pin (not shown) of each head section. Each cutter 16 has earth disintegrating teeth 17 comprised of tungsten carbide inserts interferingly secured in mating holes. Also, the teeth 17 may be milled into the steel shell of the cutter 16. Drill bit 11 has a set of external threads 19 on its upper end for securing to the lower end of the drill pipe (not shown). Drill bit 11 has an axial passage 21 for receiving drilling fluid that is pumped down the drill pipe.

Figure 2:
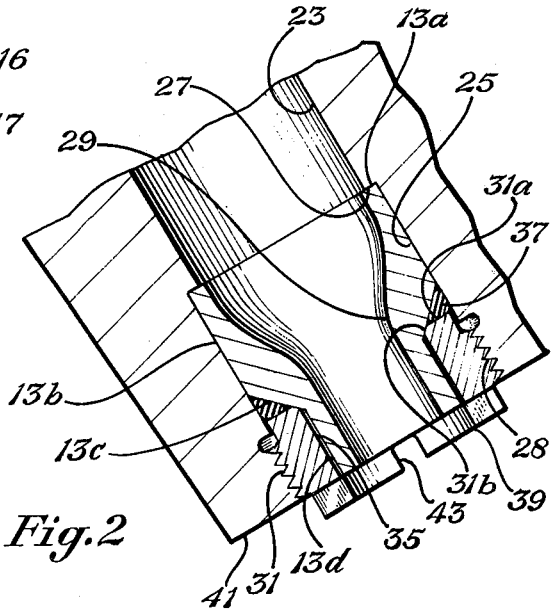
FIG. 2 is a vertical sectional view, enlarged, of one of the nozzle assemblies of the drill bit of FIG. 1.

Referring also to FIG. 2, passage 21 separates into three passages 23 (only one shown) spaced 120 degrees apart. Each passage 23 is located on a side of bit 11 between two cutters 16, and oriented generally downward for discharging fluid against the borehole bottom. Each passage 23 includes an outlet 25 that is cylindrical and of a greater diameter than the portion of passage 23 immediately upstream. Outlet 25 forms the extremity of passage 23 and defines a downwardly facing shoulder 27 at its upper end. Threads 28 are formed in the lower end of outlet 25, with the upper end of the threads terminating in a stress relief and thread run out groove.

Nozzle 13 is tightly received in the outlet 25. Nozzle 13 has an axial passage 29 extending through it. The upper section or entrance of passage 29 is cylindrical and leads into a converging midsection. The lower section or exit portion of passage 29 is cylindrical and of smaller diameter than the upper section. The diameter of the upper section of passage 29 is slightly less than the diameter of the outlet 25.

Nozzle 13 has an upper rim **13*a* that encircles the entrance of passage 29 and bears against the outlet shoulder 27. Nozzle 13 has an upper section 13*b* with a cylindrical exterior wall that fits closely within the outlet 25. The upper section 13*b* has a length that is about one-half the total axial length of nozzle 13. A tapered shoulder or midsection 13*c*, which is a frustum of a cone, is located below upper section 13*b*. A cylindrical lower section 13*d* joins the tapered section 13*c* and extends to the lower end of the nozzle 13. The lower section 13*d* has a diameter that is about $\frac{3}{4}$ the diameter of the upper section 13*b* and a length about $\frac{3}{4}$ the length of upper section 13*b***.

Nozzle 13 is preferably constructed from sintered tungsten carbide in a conventional manner. Basically, in this technique, the nozzle 13 is pressed into shape and retained by a binder while placed in a furnace for sintering the material into a composite shape.

A retaining ring 31 is used to secure the nozzle 13 in passage outlet 25. Retaining ring 31 is an annular member with threads on its exterior that screw into mating threads 28 of outlet 25. Retaining ring 31 has an axial bore 35 that is cylindrical and fits loosely around the nozzle lower section **13*d*. An upper rim 31*a* encircles bore 35. Upper rim 31*a* is located in a plane perpendicular to the axis of passage outlet 25**.

The intersection between the bore 35 and the upper rim **31*a* has a bevel 31*b* that is formed at the same angle as the nozzle tapered section 13c. Bevel 31b is thus a conical interior surface that mates with the conical exterior surface of nozzle tapered section 13c. The angle of taper is preferably 45 degrees with respect to the axis of passage outlet 25**.

An elastomeric seal 37, preferably a conventional O-ring, is located in the space between the nozzle tapered section 13c, the wall of outlet 25, and the retaining ring upper rim 31a. This space is triangular in transverse cross-section. O-ring 37 is an annular member with a circular transverse cross-sectional diameter that is less than the radial width of the retaining ring upper rim 31a.

Figure 3:
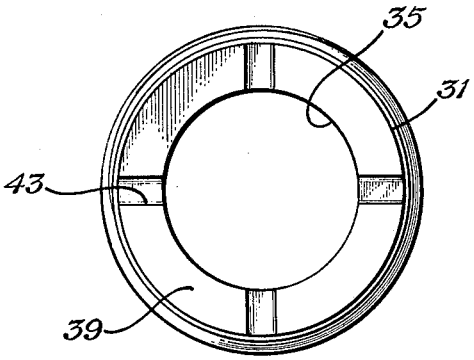
FIG. 3 is a bottom view of the retaining ring for the nozzle assembly of FIG. 1.

Retaining ring 31 has a cylindrical extended portion 39 that protrudes downwardly past the lower surface 41 of bit body 15. As shown in FIG. 3, extended portion 39 has four radial slots 43 formed within its face 90 degrees apart. Slots 43 serve to allow a key or other tool to engage it to tighten the retaining ring 31 within the outlet 25. The lower end of the nozzle 13 terminates flush with the bottom surface 41 of the bit body with the retaining ring extended portion 39 protruding past nozzle 13 a short distance.

To assemble the nozzle, first nozzle 13 is placed in the outlet 25. O-ring 37 is placed around the nozzle tapered surface 13c. Then retaining ring 31 is tightly screwed into the outlet 25. This crushes and deforms the O-ring 37 between the retaining ring 31, nozzle 13, and outlet 25 to provide a tight seal. The retaining ring bevel 31b mates and wedges against the nozzle tapered surface 13c to wedge the nozzle tightly in place.

In operation, the bit is secured to the lower end of a string of drill pipe and rotated about the axis of passage 21. Each cutter 16 rotates about its own axis to disintegrate the earth. Mud is pumped through passage 21, passages 23, and out through the nozzle passages 29 to discharge against the borehole.

The invention has significant advantages. Use of the retaining ring with its mating wedging surface tightly secures the nozzle in place. Crushing the O-ring in the space between the nozzle tapered surface and the upper rim of the retaining ring provides a tight fluid seal and avoids the need for machining a close tolerance groove in the passage outlet.

While the invention has been shown in only one of its forms, it should be apparent to those skilled in the art that it is not so limited but is susceptible to various changes and modifications without departing from the spirit of the invention.

I claim:

1. In an earth boring bit of the type having at least one passage containing a nozzle for discharging drilling fluid, the improvement comprising in combination:

a retaining ring secured in the passage and having a bore encircled by an upper rim, the upper edge of the bore contacting a tapered section formed on the nozzle for securing the nozzle in the passage; and an elastomeric seal deformed between the nozzle tapered section, the wall of the passage, and the upper rim of the retaining ring.

2. In an earth boring bit of the type having at least one passage containing a nozzle for discharging drilling fluid, the improvement comprising in combination:

a retaining ring secured into the passage and having a bore with an upper rim encircling a conical section that mates with a conical section formed on the exterior of the nozzle; and an elastomeric seal deformed between the nozzle conical section, the wall of the passage, and the upper rim of the retaining ring.

3. In an earth boring bit, means for discharging drilling fluid, comprising in combination:

at least one passage formed in the drill bit with a downwardly facing shoulder, a cylindrical wall below the shoulder, and threads below the cylindrical wall;

a nozzle having an exterior with a cylindrical wall which fits closely within the passage cylindrical wall, and a conical section below the cylindrical wall of the nozzle;

a retaining ring having exterior threads engaging the passage threads, a bore with an upper rim encircling a conical section that mates with the nozzle conical section to wedge the nozzle against the shoulder; and an O-ring crushed between the nozzle conical section, the passage cylindrical wall, and the retaining ring upper rim.

4. In an earth boring bit, means for discharging drilling fluid, comprising:

at least one passage formed in the drill bit with a downwardly facing shoulder, a cylindrical wall below the shoulder, and threads below the cylindrical wall;

a nozzle having an exterior with an upper cylindrical section and a lower cylindrical section of lesser diameter, separated by a downwardly facing tapered shoulder;

a retaining ring having exterior threads engaging the passage threads, an upper rim encircling a cylindrical bore, which has an upper edge that is beveled for contact with the nozzle tapered shoulder to wedge the nozzle against the passage shoulder, with the nozzle upper cylindrical section fitting closely within the passage cylindrical wall and the nozzle lower cylindrical section loosely within the retaining ring cylindrical bore; and an O-ring crushed between the nozzle tapered shoulder, the passage cylindrical wall and the retaining ring upper rim.

5. In an earth boring bit, means for discharging drilling fluid, comprising in combination:

at least one passage formed in the bit with a downwardly facing shoulder, a cylindrical wall below the shoulder, and threads below the cylindrical wall;

a nozzle having an exterior with an upper cylindrical section and a lower cylindrical section of lesser diameter, separated by a tapered shoulder;

a retaining ring secured by external threads in the passage and having a bore encircled by an upper rim, the inner edge of the bore contacting the nozzle tapered shoulder to secure the nozzle against the passage shoulder, with the nozzle upper section fitting closely within the passage cylindrical wall, and the nozzle lower section fitting loosely within the retaining ring cylindrical bore; and an O-ring of cross-sectional diameter no greater than the radial width of the upper rim crushed between the nozzle tapered shoulder, the passage cylindrical wall, and the retaining ring upper rim.

* * * * *

UNITED STATES PATENT OFFICE

CERTIFICATE OF CORRECTION

Patent No. 4,400,024 Dated August 23, 1983

Inventor(s) Frank C. Ratcliff and Edward M. Galle

It is certified that error appears in the above-identified patent and that said Letters Patent are hereby corrected as shown below:

The title, "Nozzle Retaining Ring With Crushed O-Ring", should be --Earth Boring Bit Having Improved Nozzle Retention Means--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*